US006041831A

United States Patent [19]

Kuoni et al.

[11] Patent Number: 6,041,831

[45] Date of Patent: Mar. 28, 2000

[54] DEVICE FOR SELECTIVE PICK-UP AND CONTROLLED OSCILLATION OF A YARN

[75] Inventors: Christian Kuoni, Zeiningen; Marco De Angelis, Zürich, both of Switzerland

[73] Assignee: Textilma AG, Hergiswil, Switzerland

[21] Appl. No.: 09/043,542

[22] PCT Filed: Sep. 6, 1996

[86] PCT No.: PCT/CH96/00315

§ 371 Date: Mar. 19, 1998

§ 102(e) Date: Mar. 19, 1998

[87] PCT Pub. No.: WO97/11215

PCT Pub. Date: Mar. 27, 1997

[30] Foreign Application Priority Data

Sep. 13, 1995 [CH] Switzerland ..... 2681/95

[51] Int. Cl.[7] ..... D03C 13/00

[52] U.S. Cl. ..... 139/55.1; 139/455; 139/59

[58] Field of Search ..... 139/55.1, 455, 139/59, 453

[56] References Cited

U.S. PATENT DOCUMENTS

| | | | |
|---|---|---|---|
| 4,195,671 | 4/1980 | Bossut | 139/453 |
| 4,532,966 | 8/1985 | Bastion et al. | 139/59 |
| 4,936,352 | 6/1990 | Keim . | |
| 5,070,913 | 12/1991 | Palmer | 139/455 |
| 5,261,464 | 11/1993 | Lorenzo et al. . | |
| 5,400,834 | 3/1995 | Lewyllie et al. | 139/453 |
| 5,477,892 | 12/1995 | Corain et al. | 139/453 |

FOREIGN PATENT DOCUMENTS

| | | | |
|---|---|---|---|
| 0 108 700 | 3/1983 | European Pat. Off. | 139/55.1 |
| 0 302 798 | 2/1989 | European Pat. Off. . | |
| 0 421 370 | 4/1991 | European Pat. Off. . | |
| 0 534 523 | 3/1993 | European Pat. Off. . | |
| 1024897 | 3/1953 | Germany | 139/55.1 |

*Primary Examiner*—Andy Falik

*Attorney, Agent, or Firm*—McCormick, Paulding & Huber LLP

[57] ABSTRACT

A device for selectively controlling oscillating transverse movement of a yarn in a loom features the integration of yarn selection mechanisms into sinkers that are connected to the loom and driven simultaneously. The yarn selection mechanisms are associated with controlled actuators for individually actuating one or more of the yarn selection mechanisms to selectively engage yarns for making specific patterns.

19 Claims, 5 Drawing Sheets

DEVICE FOR SELECTIVE PICK-UP AND CONTROLLED OSCILLATION OF A YARN

BACKGROUND OF THE INVENTION

1. Technical Field

The invention relates to a device for selectively controlling the oscillating transverse movement of a yarn, in particular a warp yarn of a loom with at least one sinker driven in an oscillating manner with at least one carrier for a yarn.

2. State of the Art

Devices of the above mentioned type are well known. For example, such devices are employed in the manufacture of patterned materials for selectively controlling the warp yarns of shaft machines or Jacquard machines. Each warp yarn therein is guided through the closed eye of a heddle, and is indirectly raised or lowered by means of the shafts of a shaft machine or the harness strings of a Jacquard machine. Such devices are otherwise known from U.S. Pat. No. 4,936,352, EP-B 0 421 370, EP-A 0 302 798, EP-A 0 534 523 and DE-C 40 23 512.

One disadvantage with this type of selection and movement of the individual warp yarns is the considerable electronic and mechanical expense which makes such large space demands in the shaft or Jacquard machines as to be close to or above that for a loom and, which is high in cost. The more individual threads that must be controlled, the more expensive the solution. As a further and greater disadvantage of existing technical apparatus, independent of the Jacquard or shaft technology, all warp yarns must be individually guided through the closed eye of the loom heddles. For drawing the yarns, considerable manual or mechanical expense is involved. Due to the guidance in the closed eye of the heddle, the degree of freedom in the yarn is reduced, so that the yarn is free to move only in the warp direction. This must be compensated for through expensive control and operation by direct elements, such as heddles, as well as indirect elements, such as shafts, harnesses, Jacquard plates, magnets and so forth, whereby the elements temporarily perform different movements of the yarns individually in the Jacquard machine or groupwise in the shaft machines.

In U.S. Pat. No. 5,261,464 a device is described which consists of heddles with open eyes in a sinker which moves up and down. This device however has other disadvantages. The design of the openings allows no connection or disconnection of the threads during weaving, but serves solely for drawing the warp threads when the loom is at rest. Still further, only a few yarn thicknesses can be accepted by the guide element due to the design. The operation of the heddles is accompanied by a great deal of mechanical expense.

SUMMARY OF THE INVENTION

It is an object of the present invention to provide a device of the above mentioned type which is designed such that direct control of a yarn is possible, which replaces the formerly closed yarn openings in the heddles, which avoids the direct elements as in shaft or Jacquard machines, and which makes possible the selection of individual yarns, in particular warp yarns with essentially minimal space demands.

This object is accomplished in the present invention by control means operated by an actuator in order to engage a yarn with a carrier. Accordingly, the carriers pickup the yarn only if the actuator operates the control means such that the yarn is engaged by the corresponding carrier. The yarn is otherwise free. On the one hand the threading of the yarn through the device is substantially facilitated, and on the other hand the yarn can be individually picked up and controlled in the simplest manner. Accordingly the control of the yarns and, correspondingly, in the case of a loom, the possibilities for making patterns in the manufactured material are substantially improved.

The device is suitable for the widest possible applications. So for example it can be used in a weft yarn transport device to selectively grasp yarns of various colors and qualities.

The device possesses in particular further substantial advantages when used in conjunction with a loom. Through the integration of the selection mechanism into the sinkers numerous useful mechanical elements for controlling and deflecting the yarns are produced, as in shaft machines, Jacquard machines and harness machines. For example, if the sinkers are connected to the shafts of a loom, they now no longer need to be driven irregularly according to the material pattern. Instead they all can be driven simultaneously for example with a sinusoidal movement, and, accordingly, they can be of a substantially simpler and more robust design which avoids costs and increases the reliability of operation. By avoiding the indirect control and operating elements between the selection device and the controlled yarns, the required forces are reduced which considerably minimizes the plant and energy demands. The warp yarns are no longer threaded through the heddles, but are freely movable along the sinkers in an uncoupled condition. During the operation of the loom as well as also during idle times they can be coupled and uncoupled which yields advantages in connecting with and threading of the yarns.

The device can be realized in various forms. Thus the carriers can be fixedly connected with the sinkers, where the control means operated by actuators serves to guide the yarns on demand to the carriers for pickup by the sinkers. One other basic embodiment of the invention is comprised by having the carriers themselves moved by means of the actuators out of an initial position, in which no yarn pickup occurs, into a carrying position in which the yarn is deflected by means of the sinker.

The carrier of a sinker can if necessary be operable in both directions of movement of the sinker. To this end the carrier is formed like a fork in which the fork opening is located transverse to the movement direction of the sinker. Advantageous, however, is the embodiment wherein the sinker is comprised by a second carrier operative in the other direction of movement, or the carrier used during the other direction of movement is connected to a further sinker. For the configuration and positioning of the carriers there are a number of variations. Thus, the carriers can be hook-shaped or at least include a notch for securely capturing the yarn. Particularly advantageous also is an arrangement of the carrier at the end of a bent control tongue. The carrier can be formed, for example, either through deformation of the control tongue or through a separate piece mounted on the control tongue. The function of the control tongue can also be assumed by means of a special configuration of the sinker already mentioned above. The certainty of capturing a yarn is improved in accordance with other embodiments.

Particularly advantageous is an embodiment whereby the yarns selected by the sinker are separated from the other yarns by means of a separating sinker. The latter can also limit the deflection of the control tongue or another movable control means. A specially advantageous arrangement and embodiment places the sinker and the separating sinkers individually a collectively on a pedestal.

The actuator is advantageously electrically controlled. The actuator can consist of various components, for example, a piezoelectric element, a magnetic coil, a permanent magnetic, a memory alloy, a bi-metal strip and others. It is essential that the actuator be electrically controllable. Especially advantageous are actuators with minimal energy consumption, such as, for example, piezoelectric elements. It is also advantageous to have a configuration whereby the elements for controlling, regulating and supervising the sinkers and the controlling acuators themselves are automatically integrated in the sinkers. Contacts or wireless connections, for example optical connections, in the base region of the sinker and conductive layers, which are integrated in or on the sinker, allow the actuators to be electrically controlled or correspondingly regulated as well as allow supervision of the state of deflection and with it the functionality.

The sinkers can be individually removed from carriers and again installed, for example, for repair purposes. It is advantageous to bundle a plurality of the sinkers together in a group indeed for control as well as for mounting, for example for exchanging the sinkers. The sinkers and separating sinkers in the base region are connected together by means of spacing pieces which have various thicknesses, so that their separation corresponds to the desired thickness of the yarn. The elements necessary for controlling the group can be either distributed on at least one of the sinkers itself or in the base region of the group, or external thereto, that is, away from the sinker and base region.

An advantageous configuration is described where the upper ends of the sinker are so formed or characterized that they project in opposite directions from one side by the correct amount, that is, that amount which corresponds to the separation in the base regions, and on the other side they likewise are separated from one another in order to be recognized and selected manually and/or through automatic yarn sensing devices.

The sinkers are connected with a known control device which controls a plurality of the sinkers so that a particular pattern can be woven. One such control device contains a computer or can be connected with a computer, and allows the input of a pattern (for example a picture) for example by means of a scanner or CAD-program and its conversion according to the operating parameters of the loom (yarn thickness in warp and weft). Accordingly the high and low points of the weaving shed are converted into corresponding control signals for the carriers situated on the sinkers so that the desired weave pattern is produced.

BRIEF DESCRIPTION OF THE DRAWINGS

Exemplary embodiments to the invention are described hereafter with the aid of the following schematic drawings which show.

DESCRIPTION OF THE PREFERRED EMBODIMENTS

Figure 1:
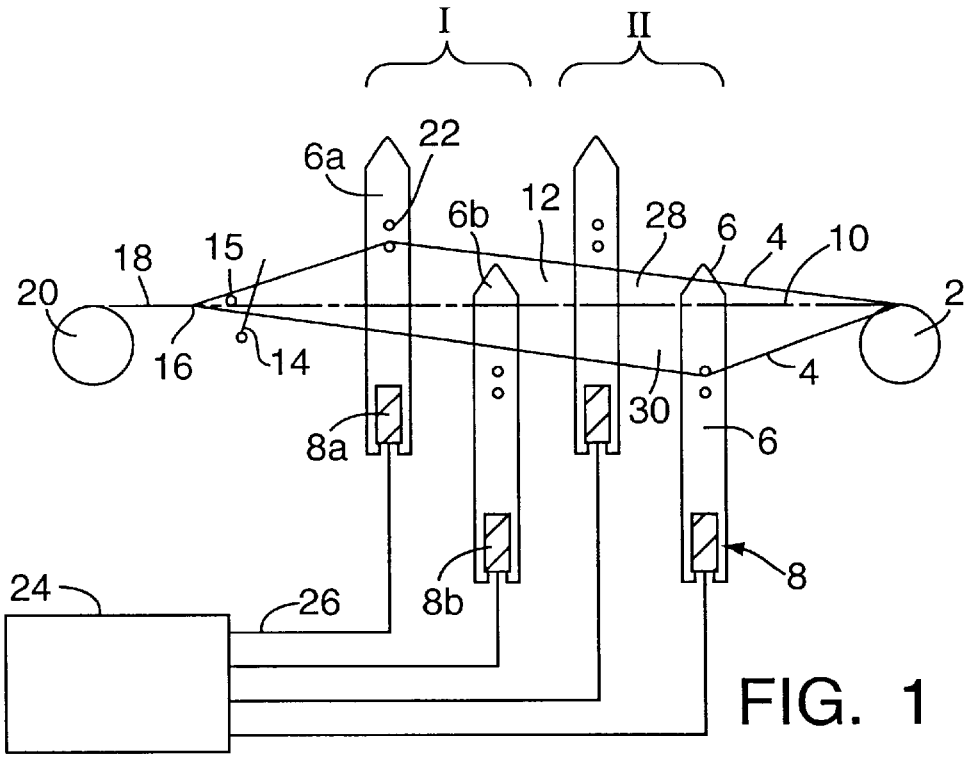
FIG. 1 a side elevation view of the weaving section of a loom in a schematic illustration.

FIG. 1 illustrates a device for selectively controlling the oscillating transverse movements of yarns, for example, for controlling warp yarns in a loom. Accordingly FIG. 1 schematically illustrates the weaving section of such a loom.

FIG. 1 shows a warp beam 2 from which the warp yarns 4 are fed and oscillate up and down transverse to their direction of movement from a rest position, that is, the mid position, for formation of a shed 12. A weaving blade or reed 14 serves to set or press a weft yarn 15 inserted into the shed 12 at one end 16 of the product. The woven material 18 produced is guided onto a product beam 20. The individual sinkers 6, 6*a*, 6*b* contain carriers 22, each of which can be driven by means of an actuator and control means from an initial position, in which it can not pick-up a yarn, into a yarn pick-up position. For operation of the actuators which are described in greater detail below, a control device 24 is provided and connected with the individual sinkers 6 by means of conductors 26.

Each sinker contains two carriers 22*a*, 22*b*, each of which is operative only during movement of the sinker in one direction to deflect the warp yarn 4 out of its mid position 10 into to the upper region 28 or the lower region 30 in order to form the shed 12. It is, however, possible to use two sinkers 6*a*, 6*b* which are positioned on two supports 8*a*, 8*b* to deflect one warp yarn 4 out of its mid position 10. Thus, the one sinker 6*a* can deflect one warp yarn 4 only into the upper region 28 while the second sinker 6*b* deflects the warp yarn into the lower region for the next weaving cycle. In this manner the operation of the sinkers in a double rhythm is possible with the carriers operating at half the weaving frequency. The construction of the loom is quite well known as well as the drive for the supports illustrated as shafts, and in this regard, for example, reference is made to the patents cited above, in particular EP A 0 534 523.

Figure 2:
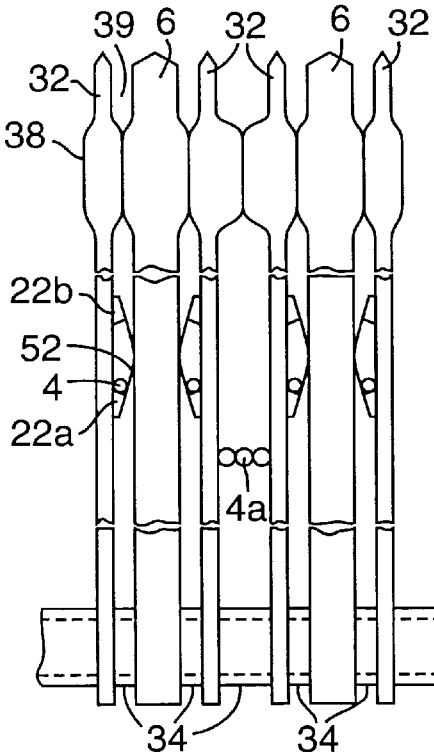
FIG. 2 a sectional view transverse to the warp showing a device for controlling the yarns.

Individual embodiments and arrangements of the sinkers are described in connection with FIGS. 2 to 6. FIG. 2 shows how a plurality of sinkers 6 are arranged in particular groups in a row on a support 8. Each sinker 6 has a separating sinker 32 placed on both of its sides with spacing determined by spacers in the form of separating pieces 34 located in a row on the support 8 between the sinkers. At both ends of the support, end pieces 36 are located and secured to fix the sinkers 6,32 and the separating pieces 34 in their respective positions on the support 8. The end pieces additionally serve as part of the energy supply and or data exchange in a manner not illustrated. At the ends of the sinkers 6 and separating sinkers 32 opposite from the support 8, the sinkers are provided with additional spacers 38 which are formed, for example, by means of bows in the housing of the sinkers. These spacers butt against the oppositely disposed spacers of the sinkers and additionally form guide surfaces 39 for passage of a yarn. The separating sinkers 32 serve on the one hand as abutments for the driven carriers 22*a*, 22*b* and on the other hand for separation of the warp yarns 4*a* which should not be processed by the respective sinkers 6. The processing of a plurality of yarns can also be divided among various sinker sets which are indicated by the sinker sets I and II in FIG. 1. One such staggering of the sinkers on support planes located one behind the other permits the warp yarn density to increase.

Figure 3:
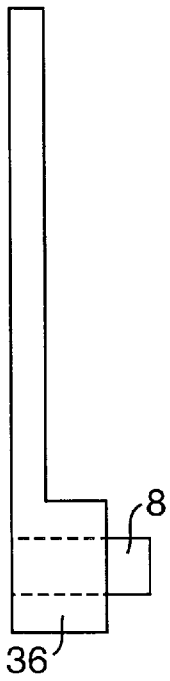
FIG. 3 an end piece for the device in FIG. 2.
Figure 4:
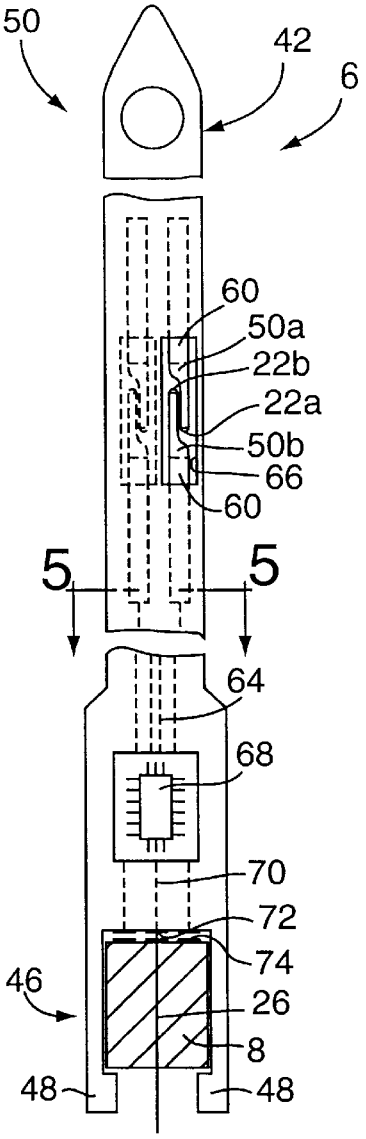
FIG. 4 a first sinker for control of a yarn and showing the carriers.
Figure 6:
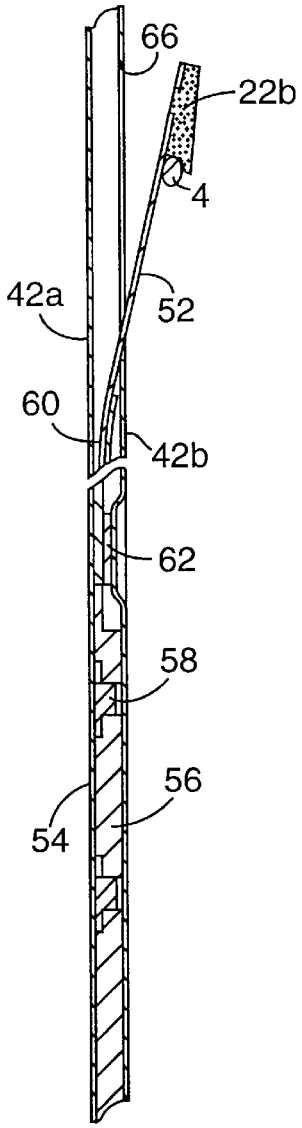
FIG. 6 a portion of the sinker of FIG. 4 in vertical cross-section and at a larger scale.
Figure 5:
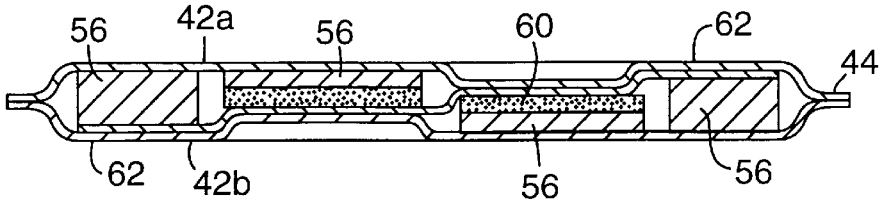
FIG. 5 the sinker of FIG. 4 as viewed along the sectioning line 5—5 at larger scale.

FIGS. 4 to 6 show individual constructions of a sinker desirable for use in FIGS. 1 to 3. The sinker consists of a housing 42 formed of two shells 42*a*, 42*b* which are, for example, welded together at their edges 44. The housing consists of a foot portion 46 with two legs 48 which are clamped around the support 8 so that the sinker can be slipped over or slid onto the support. The sinker, however, can also be connected with the support in many other manners, for example, by means of screws, adhesives and the like. Further, the sinker includes a head portion 50 over which the individual yarns are guided. On each side between the foot portion 46 and the head portion 50 a pair of carriers 22*a*, 22*b* are arranged which are operable in the two directions of movement of the sinker respectively. The carriers are fixed to the end of a control means that is constructed as a control element in the form of a control tongue 52. The tongue with the others is secured to a securing portion 54 at a reinforcing pad 56 in the housing 42 by means of adhesives and/or pins 58. An actuator 60 is secured to the control tongue which can be manufactured out of various materials, preferably spring steel. The actuator, for example, can be formed on a piezo-electric element. This actuator 60 is activated by means of conductive paths 64 which are arranged on the intermediate pad 62. As soon as the actuator 60 receives current through the conductive paths 64 a bending of the control tongue 52 is produced whereby the hook shaped carrier 22*b*, that rests in the initial position within the housing of the sinker, moves outwardly through the opening 66 in the housing 42 into a pick-up position which is shown in FIGS. 2 and 6, and in this position picks up the warp yarn 4 by the up or down movement of the sinker.

The actuators 60 for the carriers 22*a*, 22*b* on both sides of the sinker are connected through the conductive paths 64 with a circuit 68 which, for example, is an integrated circuit referred to as an IC, and is likewise located within the housing of the sinker. The circuit serves, for example, for control and supervision of the actuators 60. The circuit is connected with contacts 72 in the foot portion 46 through a plurality of conductors 70 which, for example, serve for energy supply and/or data transfer. The contacts 72 are connected with additional contacts 74 in the support 8 which are connected themselves through conductors 26 with an external control device 24. The control device controls the sinkers and/or correspondingly the carriers 22*a*, 22*b* of the sinkers in a pattern so that the warp yarns 4 are picked up by the sinkers according to the weaving pattern to be produced.

Figure 7:
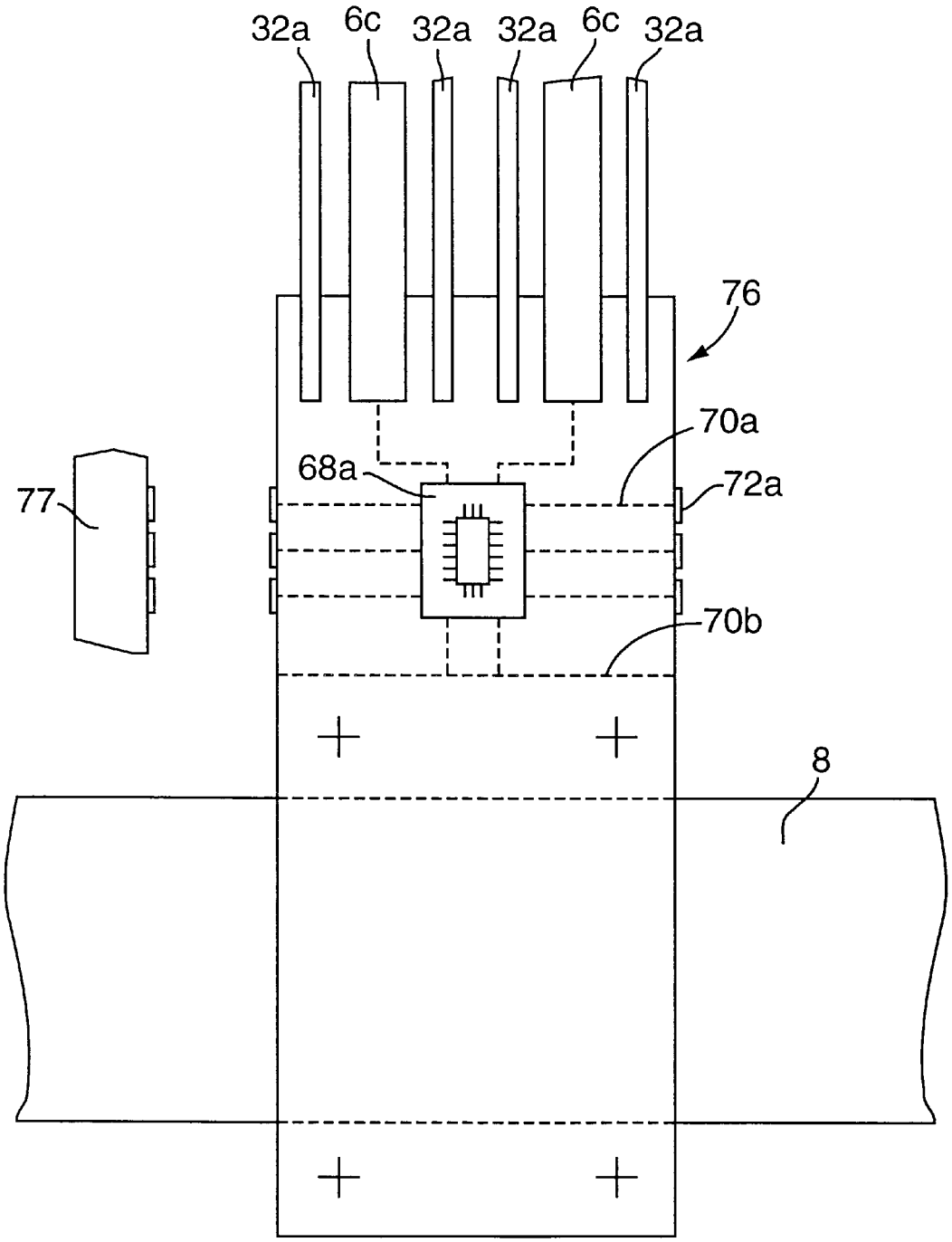
FIG. 7 a plurality of sinkers and separating sinkers arranged together in one group on a pedestal viewed transverse to the yarn direction.

In contrast to the individual arrangement of the sinkers 6 and the separating sinkers 32 on the support 8 according to FIG. 2, FIG. 7 shows how a plurality of such sinkers 6*c* and separating sinkers 32*a* are collected in one group and set or otherwise fixed in a common pedestal 76, for example, by adhesives. The pedestal 76 can then be fixed by itself to the support 8 in a manner already described above. The sinkers 6*c* are in this case connected by means of conductors 64*a* with a common circuit 68*a* for all of the sinkers of the group. The conductors 70*a* for supplying energy or providing data transfer to the circuit 68*a* here run parallel to the support 8. The conductors serving for data transfer can be formed as channels 70*b* for transfer of optical signals which are tied in a manner not illustrated with the conductors of a neighboring pedestal. The conductors 70*a* and/or channels 70*b* are connected directly or indirectly with a transfer apparatus 77 located at one end of the support for energy and/or data transfer to control the sinkers. Instead of energy being supplied over the conductors from outside, a battery for energy supply can situated in the pedestal.

Figure 8:
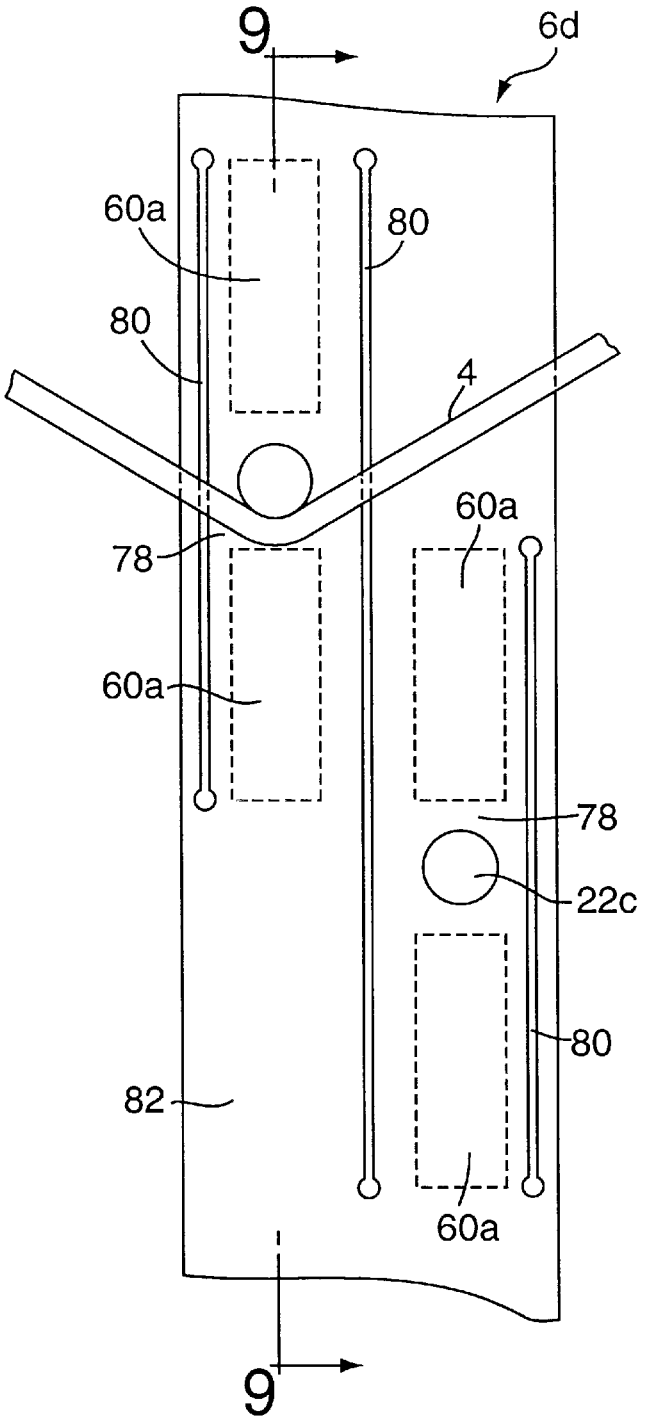
FIG. 8 another sinker showing the carriers.
Figure 9:
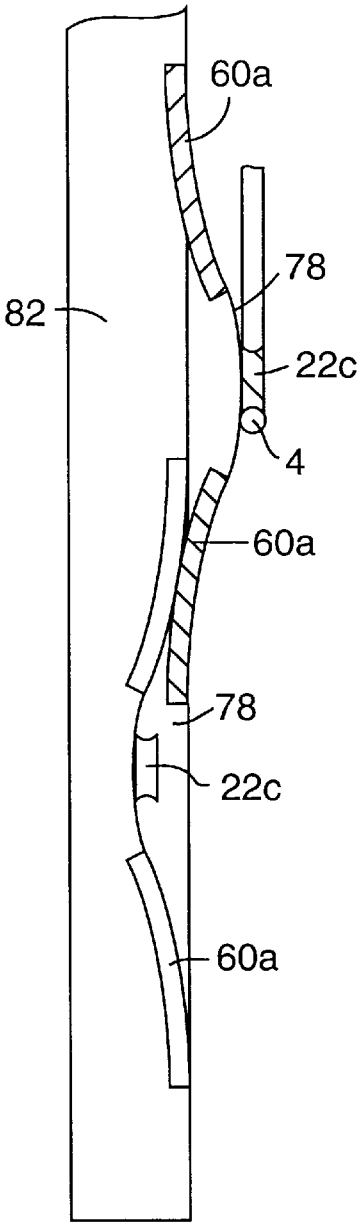
FIG. 9 the sinker of FIG. 8 in cross-section as viewed along the sectioning line 9—9 in FIG. 8.

FIGS. 8 and 9 show a section of a further sinker 6*d* in which the control means is designed for example as a membrane 78 which can be part of the housing 82. The membranes 78 have actuators 60*a*. The membranes 78 are moved in and out on demand by means of the actuators 60*a* from an initial position within the interior of the housing 82 into a pick-up position in which they project from the housing.

Figure 10:
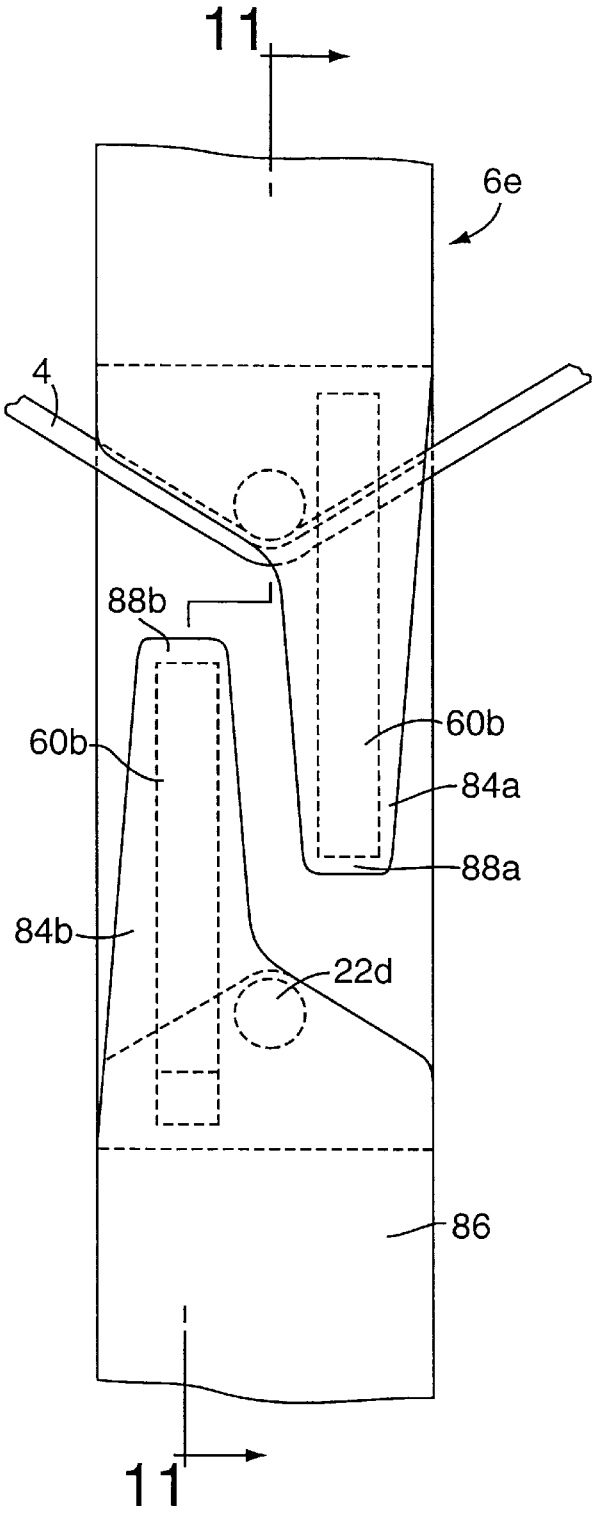
FIG. 10 another sinker showing the carriers.
Figure 11:
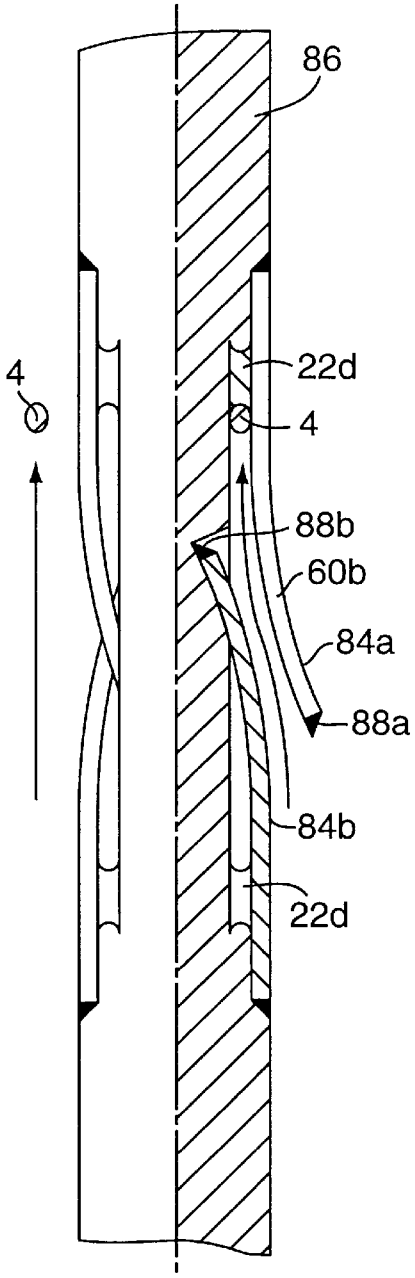
FIG. 11 the sinker of FIG. 10 in cross-section as viewed along the sectioning line 11—11.

FIGS. 10 and 11 show a further variation of the sinkers 6*e* in cross-section. The control means are formed as deflection means and are comprised of deflection tongues 84 which are arranged in pairs on each side of the housing 86 with actuators 60*b*. The deflection tongues in their base regions cover up the carriers 22*d* which are fixedly arranged in the housing 86 of the sinker 6*e*. In the pick-up position the free end 88*a* of a deflection tongue 84*a* sticks out into the slide path of the yarn 4, and the free end 88*b* of the other associated deflecting tongue 84*b* points inward and forms a slide for guiding the yarn 4 into the carrier 22*d*. In the initial position both deflection tongues 84*a* and 84*b* point inwardly and prevent a yarn from being picked up.

We claim:

1. A device for selectively controlling the oscillating transverse movements of yarns, in particular a warp yarn of a loom said device including at least one sinker driven in an oscillating manner with at least one carrier for picking up, moving and releasing of a yarn, the device being characterized in that control means operated by means of an actuator are provided in to engage the yarn with the carrier.

2. Device according to claim 1 characterized in that the control means is formed as deflection means, which is moved by means of the actuator between an initial position, in which a yarn 4 is not picked up, and a pick-up position, in which a yarn deflection by the at least one carrier connected to the sinker is produced.

3. A device according to claim 2 characterized in that the control means has regions of various stiffness whereby, for example, a first region located in a base of the control means is preferably more flexible than a second region associated with the carrier.

4. A device according to claim 2 characterized in that said deflection means comprise a deflection tongue.

5. The device according to claim 1 characterized in that the control means is formed as a control element, which supports the carrier and is movable by means of the actuator between an initial position in which there is no yarn pick-up and a pick-up position for picking up a yarn.

6. A device according to claim 5 characterized in that the control element is formed as membrane which is part of a housing and which supports the carrier.

7. A device according to claim 5 characterized in that said control means comprises a control tongue.

8. A device according to claim 1 characterized in that the carrier is configured and oriented such that it is operable during only one direction of movement of the sinker and the sinker has one additional carrier that is configured and oriented such that it is operable during the other direction of movement.

9. A device according to claim 1 in that a separating sinker is located on the side of the at least on sinker bearing the at least one carrier and the control means rests against the separating sinker in the pick-up position.

10. The device according to claim 9 characterized in that a spacer is arranged between the at least one sinker and the separating sinker whereby the spacer forms a guide surface making possible the passage of a yarn.

11. A device according to claim 1 further characterized by a plurality of separate sinkers for one or more yarns arranged on one support or on a plurality of supports whereby separating sinkers are arranged between adjacent sinkers.

12. A device according to claim 11 characterized in that the sinkers and the separating sinkers are interchangeably arranged individually or collectively in groups on a pedestal on the support.

13. A device according to claim 1 characterized in that the actuator is electrically controllable with a control device.

14. A device according to claim 13 characterized in that the at least one sinker has a foot portion or a pedestal which includes a contact portion for connection to a control conductor.

15. A device according to claim 1 characterized in that the at least one sinker includes at least one partially conductive pad for control of the actuator and/or supervision of the condition of the at least one sinker.

16. A device according to claim 1 characterized by a circuit for each individual sinker or a group of sinkers for controlling and/or regulating and/or supervision.

17. A device according to claim 1 characterized in that the at least one sinker and/or a pedestal connected therewith and/or a support for the sinker or the pedestal includes or include an electro-optical apparatus for data transfer.

18. A device according to claim 1 characterized in that the at least one sinker is one of multiple sinkers, and the upper ends of the sinkers are so formed that they are distinguishable from each of the adjacent sinkers on the basis of their geometry and/or optical elements.

19. A device according to claim 18 characterized in that said optical elements comprise light diodes.

* * * * *

UNITED STATES PATENT AND TRADEMARK OFFICE

CERTIFICATE OF CORRECTION

PATENT NO. : 6,041,831
DATED : March 28, 2000
INVENTOR(S) : Christian Kuoni et al.

It is certified that error appears in the above-identified patent and that said Letters Patent is hereby corrected as shown below:

Column 2, line 66, please delete "sinker" and insert -- sinkers --.

In the Claims:

Claim 1, line 3, after "loom" please insert --,-- and line 7, after "in" please insert --order--.

Claim 2, line 4, please delete "4".
Claim 3, lines 2-3, please delete "for example," and line 4, please delete "the" and insert --a--.
Claim 9, line 2, please delete "on" (second occurrence) and insert --one-- and line 4, please delete "the" and insert --a--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*